US010734141B2

(12) United States Patent
Lee et al.

(10) Patent No.: US 10,734,141 B2
(45) Date of Patent: Aug. 4, 2020

(54) ELECTRONIC COMPONENT AND MANUFACTURING METHOD THEREOF

(71) Applicant: SAMSUNG ELECTRO-MECHANICS CO., LTD., Suwon-si, Gyeonggi-do (KR)

(72) Inventors: Jong Pil Lee, Suwon-si (KR); Doo Ho Yoo, Suwon-si (KR); Hyung Gon Kim, Suwon-si (KR); Jung Il Kim, Suwon-si (KR); Hyun Jun Choi, Suwon-si (KR); Hyung Seok Roh, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 16/298,394

(22) Filed: Mar. 11, 2019

(65) Prior Publication Data

US 2020/0090841 A1 Mar. 19, 2020

(30) Foreign Application Priority Data

Sep. 17, 2018 (KR) ..... 10-2018-0110895

(51) Int. Cl.
*H01C 7/00* (2006.01)
*H01C 1/14* (2006.01)
(Continued)

(52) U.S. Cl.
CPC ..... *H01C 7/006* (2013.01); *H01C 1/012* (2013.01); *H01C 1/14* (2013.01); *H01C 17/006* (2013.01); *H01C 17/288* (2013.01)

(58) Field of Classification Search
CPC ..... H01C 7/006; H01C 1/012; H01C 1/14; H01C 17/006; H01C 17/288
See application file for complete search history.

(56) References Cited

U.S. PATENT DOCUMENTS 6,144,287 A 11/2000 Komeda
6,437,681 B1 * 8/2002 Wang ..... G01K 7/183 338/25
(Continued)

FOREIGN PATENT DOCUMENTS

JP 2002-064002 A 2/2002
JP 2005-085865 A 3/2005
(Continued)

OTHER PUBLICATIONS

JP 2010-062407, Kanda et al., machine translation. (Year: 2010).*
Korean Office Action dated Oct. 22, 2019 issued in Korean Patent Application No. 10-2018-0110895 (with English translation).

*Primary Examiner* — Kyung S Lee
(74) *Attorney, Agent, or Firm* — Morgan, Lewis & Bockius LLP

(57) ABSTRACT

An electronic component and a manufacturing method thereof are disclosed. The electronic component includes a substrate, a conductor pattern portion disposed on the substrate, a first electrode pattern and a second electrode pattern disposed on the conductor pattern portion, at least one dummy conductor pattern disposed to be spaced apart from the conductor pattern portion and disposed on the substrate, and at least one dummy electrode pattern disposed on the at least one dummy conductor pattern. A width of the first electrode pattern is substantially the same as a width of a portion of the conductor pattern portion in contact with the first electrode pattern, and a width of the second electrode pattern is substantially the same as a width of a portion of the conductor pattern portion in contact with the second electrode pattern.

20 Claims, 13 Drawing Sheets

(51) Int. Cl.

| | |
|---|---|
| ***H01C 1/012*** | (2006.01) |
| ***H01C 17/00*** | (2006.01) |
| ***H01C 17/28*** | (2006.01) |

(56) References Cited

U.S. PATENT DOCUMENTS

| | | | | |
|---|---|---|---|---|
| 7,667,569 | B2 * | 2/2010 | Iseki | H01C 1/14 29/610.1 |
| 7,940,158 | B2 * | 5/2011 | Yoneda | H01C 1/012 338/307 |
| 2002/0031860 | A1 | 3/2002 | Tanimura | |
| 2019/0221658 | A1 * | 7/2019 | Yoneda | H01L 29/407 |

FOREIGN PATENT DOCUMENTS

| | | | |
|---|---|---|---|
| JP | 2005-223272 | A | 8/2005 |
| JP | 2009-141171 | A | 6/2009 |
| JP | 2010-062407 | A | 3/2010 |
| JP | 4745027 | B2 | 8/2011 |
| JP | 4881557 | B2 | 2/2012 |
| KR | 10-2000-0022053 | A | 4/2000 |
| KR | 10-2018-0054257 | A | 5/2018 |

* cited by examiner

ELECTRONIC COMPONENT AND MANUFACTURING METHOD THEREOF

CROSS-REFERENCE TO RELATED APPLICATION(S)

This application claims benefit of priority to Korean Patent Application No. 10-2018-0110895 filed on Sep. 17, 2018 in the Korean Intellectual Property Office, the disclosure of which is incorporated herein by reference in its entirety.

TECHNICAL FIELD

The present disclosure relates to a thin film electronic component and a manufacturing method thereof.

BACKGROUND

Miniaturization of electronic devices and reductions in manufacturing costs thereof are continuously required. Therefore, miniaturization, thinning, and reductions of manufacturing costs are also continuously required for various electronic components applied to the electronic devices.

In order to miniaturize and thin electronic components, thin film electronic components having thinly formed electrodes and various patterns included in the electronic components have been widely developed. However, in the case of conventional thin type electronic components, expensive equipment is required and manufacturing costs thereof are thus increased.

SUMMARY

An aspect of the present disclosure may provide a manufacturing method of an electronic component capable of reducing manufacturing costs of the electronic component while miniaturizing and thinning the electronic component.

An aspect of the present disclosure may provide an electronic component manufactured according to the manufacturing method of the electronic component.

According to an aspect of the present disclosure, an electronic component may include a substrate; a conductor pattern portion disposed on the substrate and extending in a first direction; a first electrode pattern and a second electrode pattern disposed at opposite ends of the conductor pattern portion in the first direction and disposed on the conductor pattern portion, respectively; at least one dummy conductor pattern spaced apart from the conductor pattern portion and disposed on the substrate; and at least one dummy electrode pattern spaced apart from the first electrode pattern and the second electrode pattern and disposed on the at least one dummy conductor pattern, wherein a width, in a second direction different from the first direction, of the first electrode pattern is substantially the same as a width, in the second direction different from the first direction, of a portion of the conductor pattern portion in contact with the first electrode pattern, and a width, in the second direction different from the first direction, of the second electrode pattern is substantially the same as a width, in the second direction different from the first direction, of a portion of the conductor pattern portion in contact with the second electrode pattern.

According to another aspect of the present disclosure, a manufacturing method of an electronic component may include forming a conductor film on a substrate; forming at least one first paste portion extending in a second direction on the substrate on which the conductor film is formed; forming an electrode film on the substrate on which the conductor film and the at least one first paste portion are formed; and forming a plurality of primary electrode patterns by removing the at least one first paste portion.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

In addition, as an example of an electronic component, a thin film chip resistor will hereinafter be described. However, the electronic component according to the present disclosure is not limited to the resistor, but may include various types of electronic components such as a chip inductor, a chip capacitor, and the like.

FIGS. 1A through 1G are views illustrating a manufacturing method of an electronic component according to an exemplary embodiment in the present disclosure.

Figure 1A:
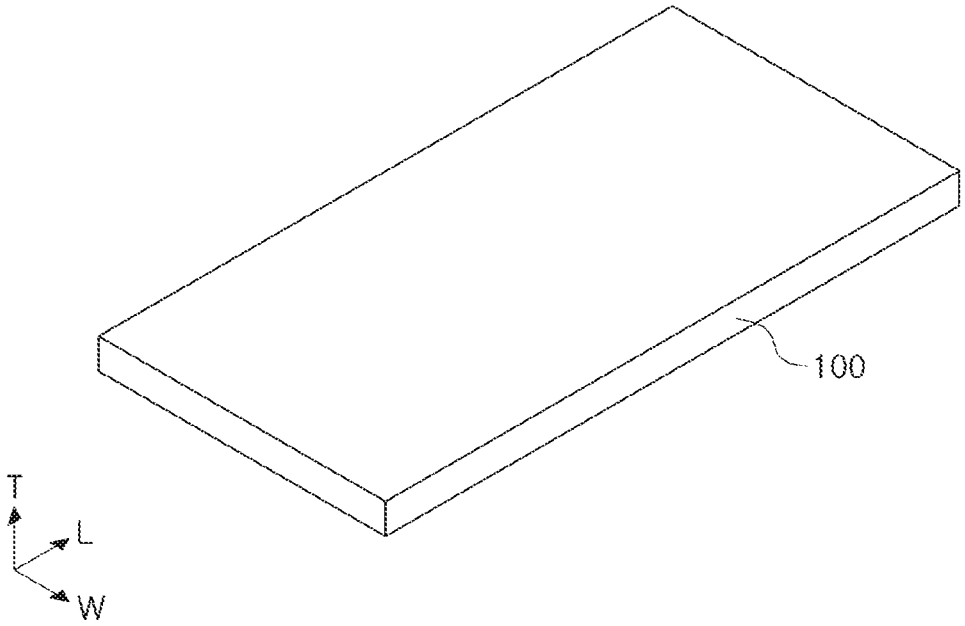
FIGS. 1A through 1G are views illustrating a manufacturing method of an electronic component according to an exemplary embodiment in the present disclosure.

First, a substrate 100 may be prepared (FIG. 1A). In the drawings, T refers to a thickness direction, L refers to a length direction, and W refers to a width direction. (Hereinafter, this will be applied to all drawings in the same manner).

Figure 1B:
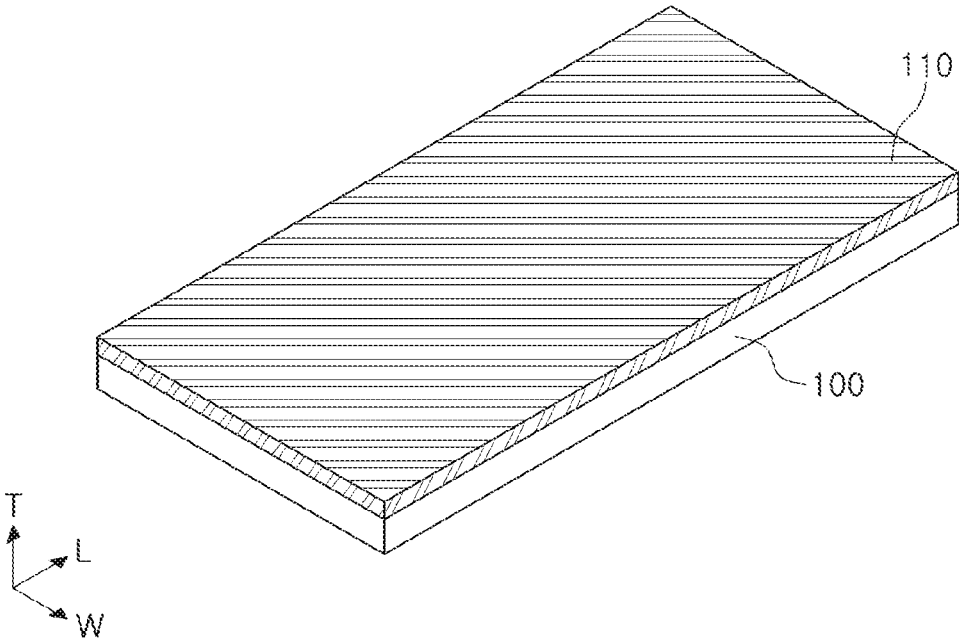

Next, a resistive film 110 may be formed on the substrate 100 (FIG. 1B). For example, the resistive film 110 may be formed by a thin film sputtering method. Here, the resistive film 110 may be formed on a front surface of the substrate 100. In addition, the resistive film 110 may be a nickel-chromium (NiCr) based alloy or various alloy materials including nickel (Ni) or chromium (Cr). The resistive film 110 may have substantially the same thickness on the entirety of the substrate.

Figure 1C:
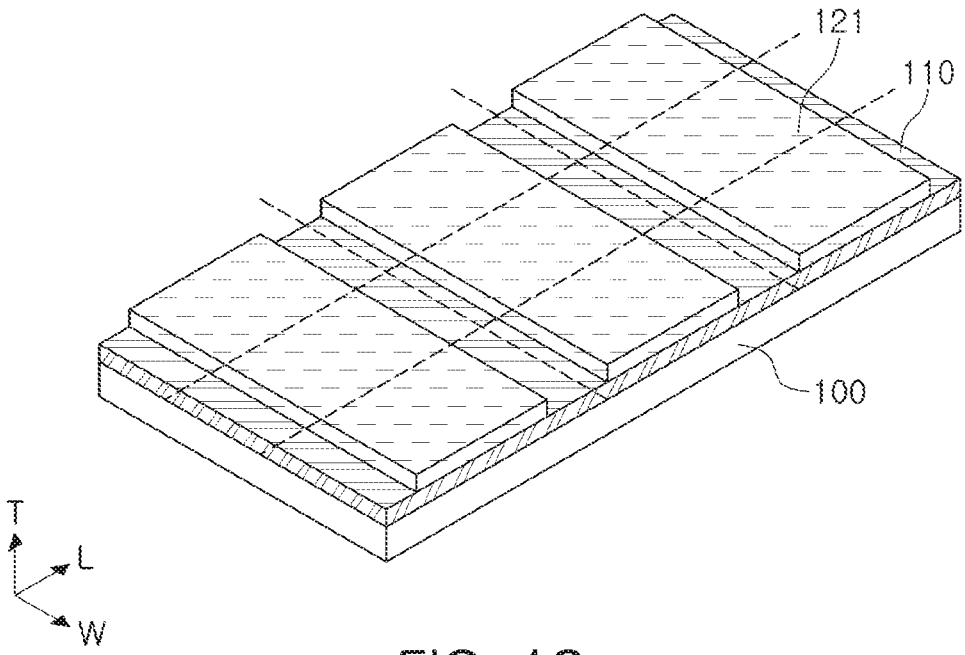

Next, a first paste portion 121 forming a primary electrode pattern may be formed on the substrate 100 on which the resistive film 110 (FIG. 1C). Here, the first paste portion 121 may be formed by a screen print method. In addition, the first paste portion 121 may have the form of at least one stripe extending in a second direction. The second direction may be a width direction of the substrate 100. In addition, the first paste portion 121 may be a mixture of an organic material and an inorganic material, and may be removed by an organic material remover.

Figure 1D:
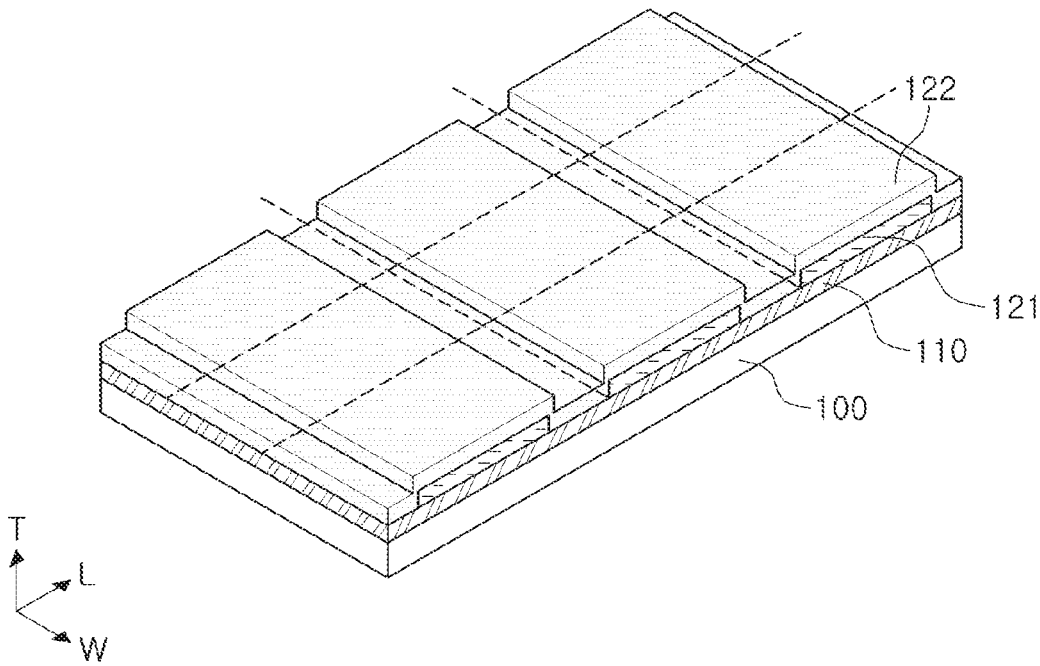

Next, an electrode film 122 may be formed on the substrate 100 on which the resistive film 110 and the first paste portion 121 are formed (FIG. 1D). For example, the electrode film 122 may be formed by a thin film sputtering method. Here, the electrode film 122 may be formed on the front surface of the substrate 100 on which the resistive film 110 and the first paste portion 121 are formed. In addition, the electrode film 122 may include a underlayer including nickel (Ni), chromium (Cr), and/or nickel-chromium (NiCr), and an electrode layer including a metal having excellent electrical conductivity such as copper (Cu), silver (Ag), gold (Au), and/or platinum (Pt). The underlayer may secure adhesion and the electrode layer may substantially serve as an electrode. The electrode film 122 may have substantially the same thickness on the entirety of the substrate 100. In addition, the electrode film 122 may have a thickness greater than that of the resistive film 110. Therefore, a thickness of an electrode pattern in the electrode component may be greater than that of a resistance pattern.

Figure 1E:
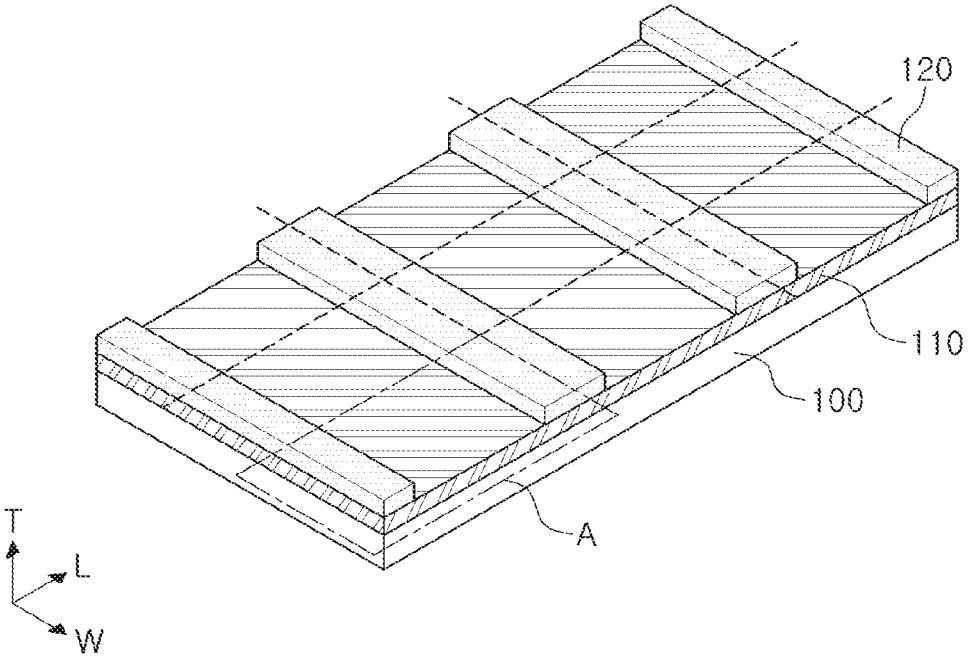

Next, the first paste portion 121 may be removed (FIG. 1E). When the first paste portion 121 is removed, a primary electrode pattern 120 may be formed on the remaining portions except for portions on which the first paste portion 121 is present. The primary electrode pattern 120 may have the form of at least one stripe extending in a second direction. The second direction may be a width direction of the substrate 100. As described above, the first paste portion 121 may be removed by using the organic material remover (e.g., an organic material removing solution). That is, the first paste portion 121 may be selectively removed without damaging the resistive film 110 formed below the first paste portion 121 by removing the first paste portion 121 in which the organic material and the inorganic material are mixed by using the organic material remover.

Figure 1F:
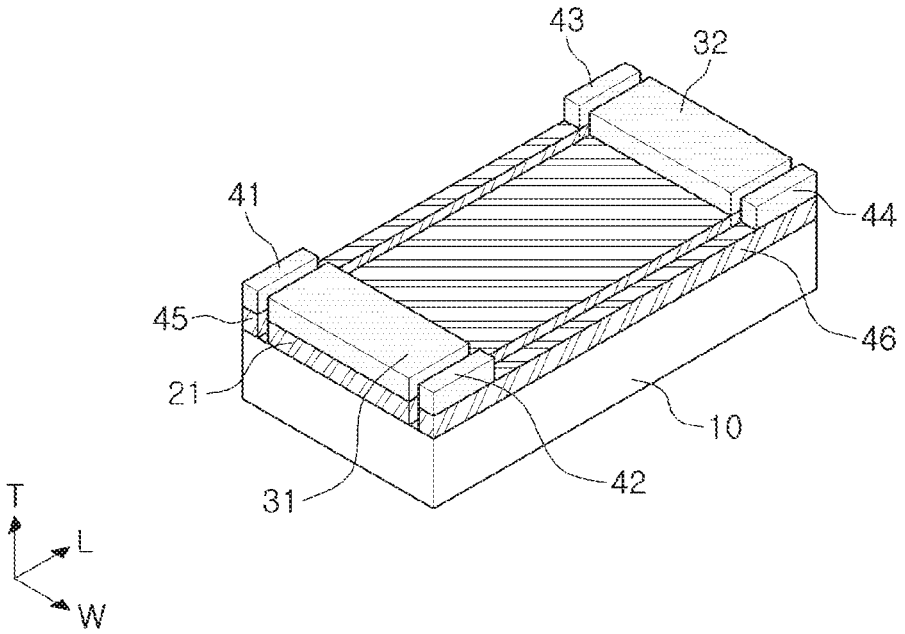
Figure 1G:
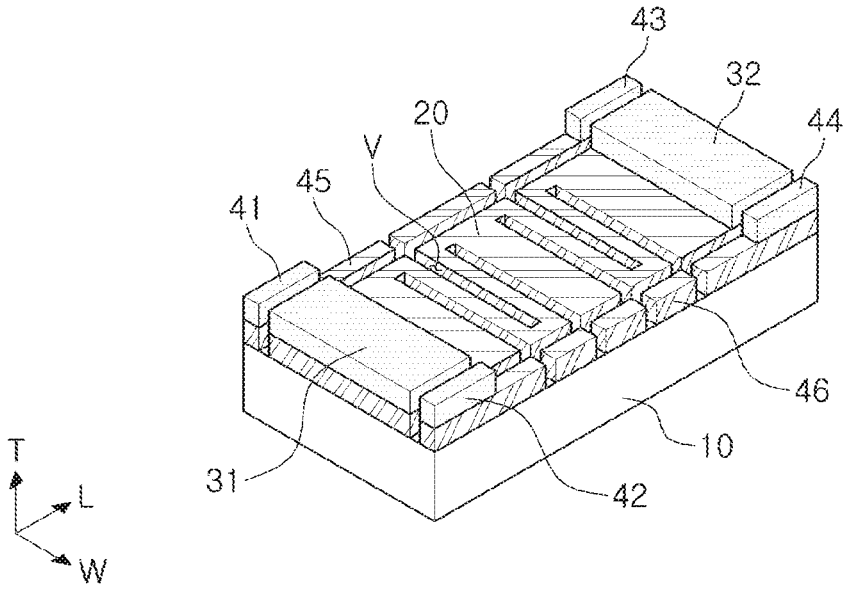

Next, a resistance pattern 21 having a desired width may be formed (FIG. 1F). (Hereinafter, FIGS. 1F and 1G illustrate a region A in FIG. 1E, that is, one chip resistor. According to an exemplary embodiment in the present disclosure, a plurality of chip resistors may be manufactured by cutting out the substrate 100 on which the resistive films 110 and the primary electrode pattern 120 illustrated in FIG. 1E are formed along dotted lines). For example, the resistance pattern 21 may be formed by forming a groove extending in a first direction (e.g., a length direction of the substrate 10) in the resistive film 110 with laser. Thereby, the electronic component according to an exemplary embodiment in the present disclosure may include a first dummy resistance pattern 45 and a second dummy resistance pattern 46 that are disposed on the substrate 10 to be spaced apart from the resistance pattern 21 in the second direction of the resistance pattern 21 (e.g., the width direction of the substrate 10).

In addition, a portion of the primary electrode pattern 120 may be removed while forming the resistance pattern with the laser. That is, a groove formed in the resistive film may extend up to the primary electrode pattern. Thereby, the chip resistor according to an exemplary embodiment in the present disclosure may include a first dummy electrode pattern 41 and a second dummy electrode pattern 42 formed at opposite sides of a first electrode pattern 31 in the second direction (e.g., the width direction of the substrate 10) and separated from the first electrode pattern 31, and a third dummy electrode pattern 43 and a fourth dummy electrode pattern 44 formed at opposite side of a second electrode pattern 32 in the second direction (e.g., the width direction of the substrate 10) and separated from the second electrode pattern 32, in addition to the first electrode pattern 31 and the second electrode pattern 32 that are disposed at opposite ends of the chip resistor in the first direction (e.g., opposite ends of the substrate 10 in the length direction thereof).

Next, a resistance portion 20 of the chip resistor may be formed by forming at least one pattern groove V in the resistance pattern 21 (FIG. 1G). That is, at least one pattern groove V may be formed in the resistance pattern 21 to adjust a resistance value of the chip resistor. The pattern groove V may be implemented in various forms, for example, I cut, L cut, double cut, or I cut of a zigzag shape. A resistance portion or a resistance pattern may be alternatively named as a conductor portion or a conductor pattern, as the resistance portion or the resistance pattern is made of an electrically conductive material with resistivity. Such a resistance portion (or a conductor portion) or a resistance pattern (or a conductor pattern) provides resistance and also electrically conductive. The resistance portion (or the resistance pattern) and the conductor portion (or the conductor pattern) may be exchangeable.

As the laser used at the time of forming the resistance pattern, a laser having a relatively large size of spot or a high power based laser may be applied. In addition, the laser used at the time of forming the pattern groove V in the resistance pattern 21 may have a relatively small size of spot.

Figure 2A:
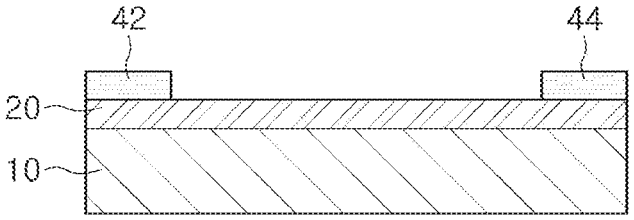
FIGS. 2A through 2C are views schematically illustrating an electronic component manufactured according to the manufacturing method of the electronic component according to an exemplary embodiment in the present disclosure illustrated in FIGS. 1A through 1G.
Figure 2B:
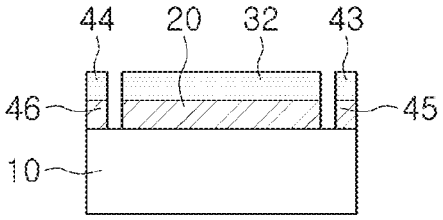
Figure 2C:
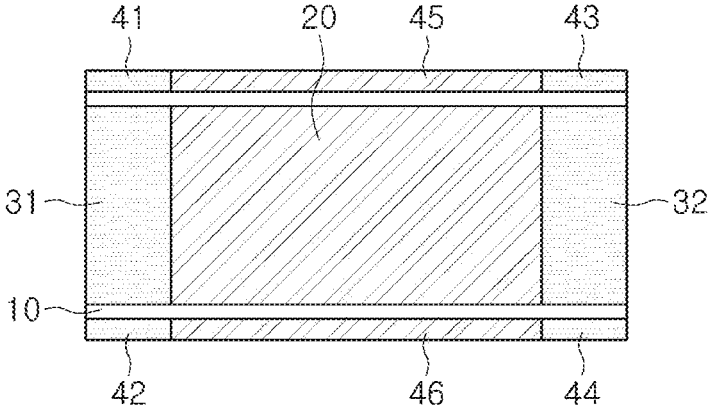

FIGS. 2A through 2C are views schematically illustrating an electronic component manufactured according to the manufacturing method of the electronic component according to an exemplary embodiment in the present disclosure illustrated in FIGS. 1A through 1G. FIG. 2A illustrates a front view when viewed in the width direction of the electronic component, FIG. 2B is a side view when viewed in the length direction thereof, and FIG. 2C illustrates a plan view when viewed in the thickness direction thereof.

As illustrated in FIGS. 2A through 2C, the electronic component according to an exemplary embodiment in the present disclosure may include the substrate 10, the resistance portion 20 disposed on the substrate 10 and extending in the first direction (e.g., the length direction of the substrate), the first dummy resistance pattern 45 and the second dummy resistance pattern 46 disposed to be spaced apart from the resistance portion 20 at opposite sides of the resistance portion 20 in the second direction and disposed on the substrate 10, the first electrode pattern 31 and the second electrode pattern 32 disposed at opposite ends of the resistance portion 20 in the first direction and disposed on the resistance portion 20, the first dummy electrode pattern 41 and the second dummy electrode pattern 42 disposed to be spaced apart from the first electrode pattern 31 at opposite sides of the first electrode pattern 31 in the second direction (e.g., the width direction of the substrate) different from the first direction and disposed on the first dummy resistance pattern 45 and the second dummy resistance pattern 46, respectively, and the third dummy electrode pattern 43 and the fourth dummy electrode pattern 44 disposed to be spaced apart from the second electrode pattern 32 at opposite sides of the second electrode pattern 32 in the second direction (e.g., the width direction of the substrate) and disposed on the first dummy resistance pattern 45 and the second dummy resistance pattern 46, respectively.

As described above, the first electrode pattern 31 and the second electrode pattern 32 may be formed in the process of forming the resistance pattern by removing a portion of the resistive film after forming the primary electrode pattern on the resistive film. Therefore, a width of the first electrode pattern 31 may be the same as a width of a portion of the resistance portion 20 that the first electrode pattern 31 is formed. Similarly, a width of the second electrode pattern 32 may be the same as a width of a portion of the resistance portion 20 that the second electrode pattern 32 is formed.

Figure 3A:
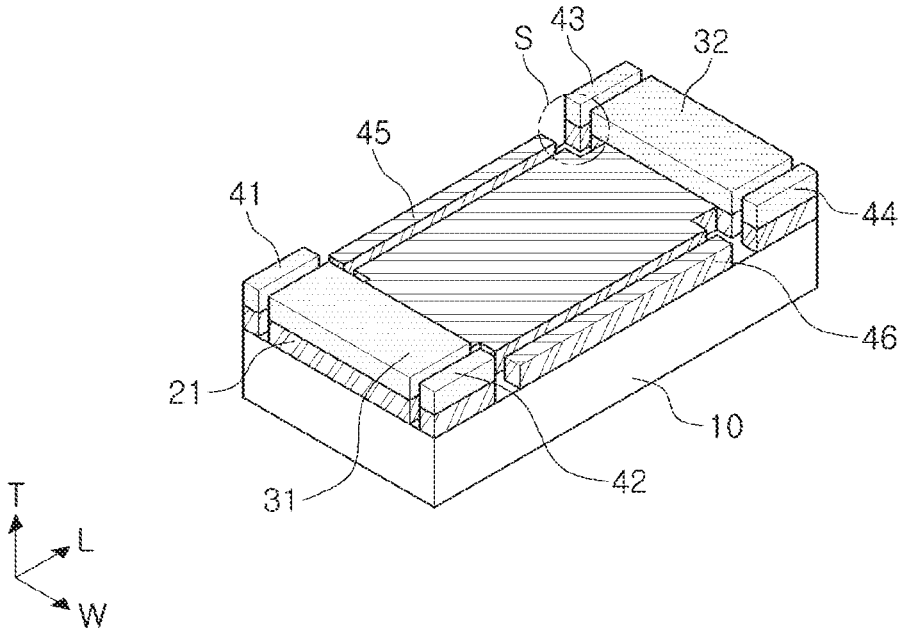
FIGS. 3A through 5B are views illustrating a manufacturing method of an electronic component according to an exemplary embodiment in the present disclosure.
Figure 3B:
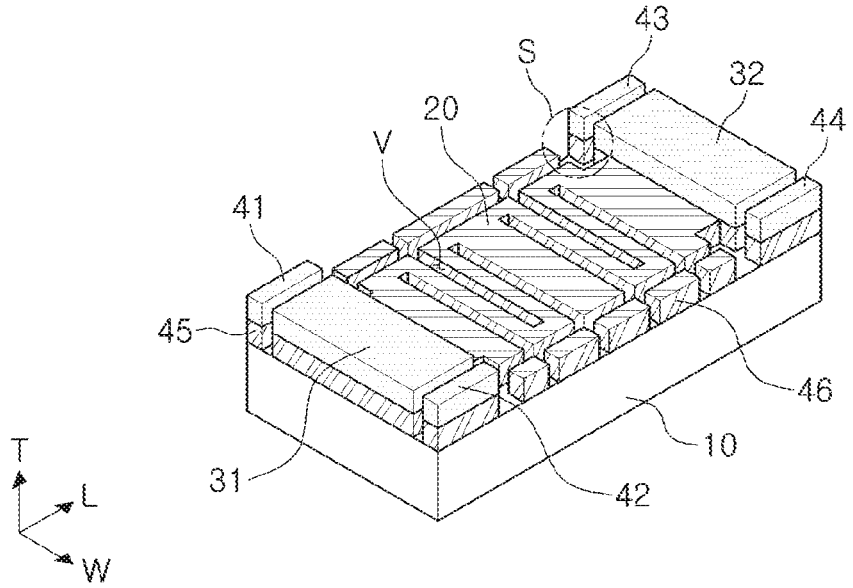

FIGS. 3A and 3B are views illustrating a manufacturing method of an electronic component according to an exemplary embodiment in the present disclosure. According to the manufacturing method of an electronic component according to an exemplary embodiment in the present disclosure, at least one open pattern S may be formed while forming the resistance pattern 21.

As illustrated in FIG. 3A, in the electronic component according to an exemplary embodiment in the present disclosure, open patterns may be formed by removing predetermined portions of boundary portions at which the first electrode pattern 31 and the second electrode pattern 32 are in contact with the resistance pattern 21 from the resistance pattern 21. More specifically, the open patterns may be formed by removing both end portions of the boundary portion at which the resistance pattern 21 is in contact with the first electrode pattern 31 in the second direction (e.g., the width direction of the substrate 10), and both end portions of the boundary portion at which the resistance pattern is in contact with the second electrode pattern 32 in the second direction, from the resistance pattern 21. Here, the open patterns may extend to the first dummy resistance pattern 45 and the second dummy resistance pattern 46. Therefore, the first dummy resistance pattern 45 and the second dummy resistance pattern 46 may be disconnected from the dummy electrode patterns 41, 42, 43, and 44.

Next, a resistance portion 20 of the chip resistor may be formed by forming at least one pattern groove V in the resistance pattern 21 (FIG. 3B).

Figure 4A:
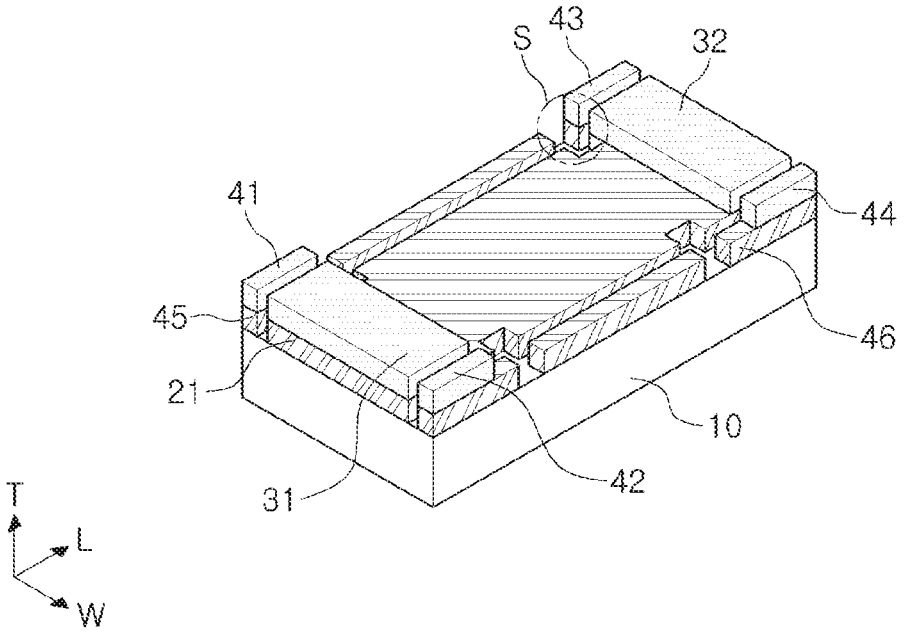
Figure 4B:
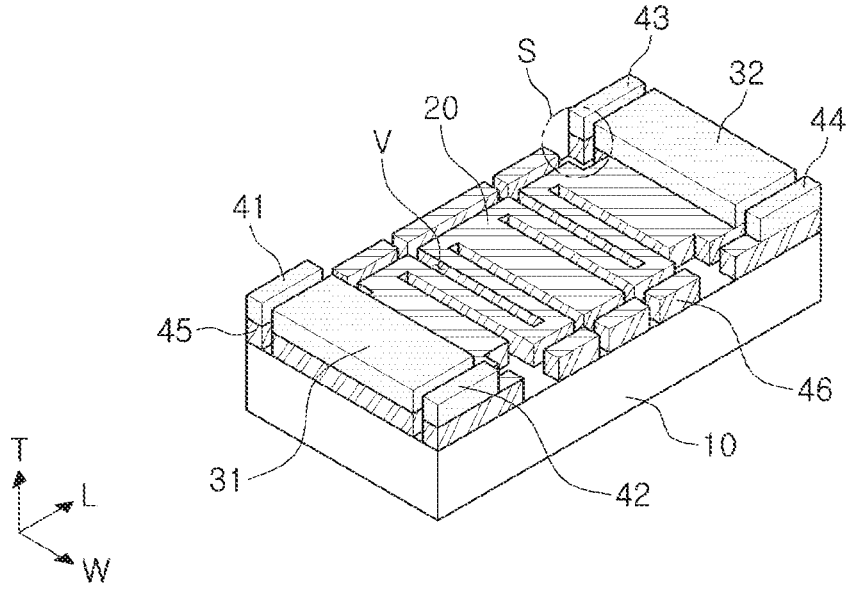

FIGS. 4A and 4B are views illustrating a manufacturing method of an electronic component according to an exemplary embodiment in the present disclosure.

As illustrated in FIG. 4A, at least one of the open patterns S may be spaced apart from the boundary portion between the resistance pattern 21 and the electrode patterns 31 and 32. In addition, as described with reference to FIG. 3A, the open patterns may extend to the dummy resistance patterns 45 and 46.

Next, a resistance portion 20 of the chip resistor may be formed by forming at least one pattern groove V in the resistance pattern 21 (FIG. 4B).

Since the electronic component according to an exemplary embodiment in the present disclosure may include at least one open pattern, a short failure that may occur during a subsequent plating process may be prevented. More specifically, since at least one open pattern is formed, a contact between the dummy resistance patterns 45 and 46 and the electrode patterns 31 and 32 may be prevented when the plating process is performed.

Figure 5A:
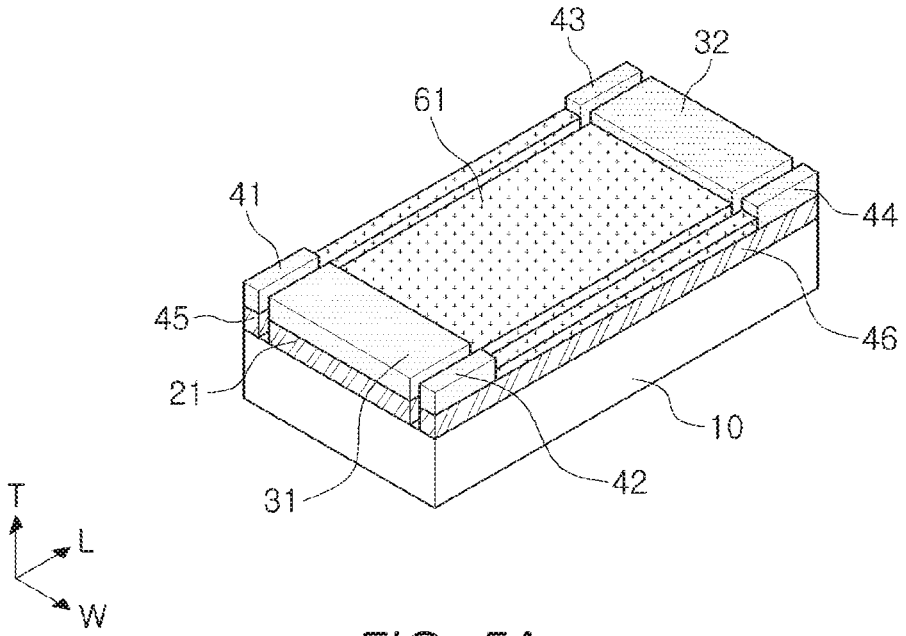
Figure 5B:
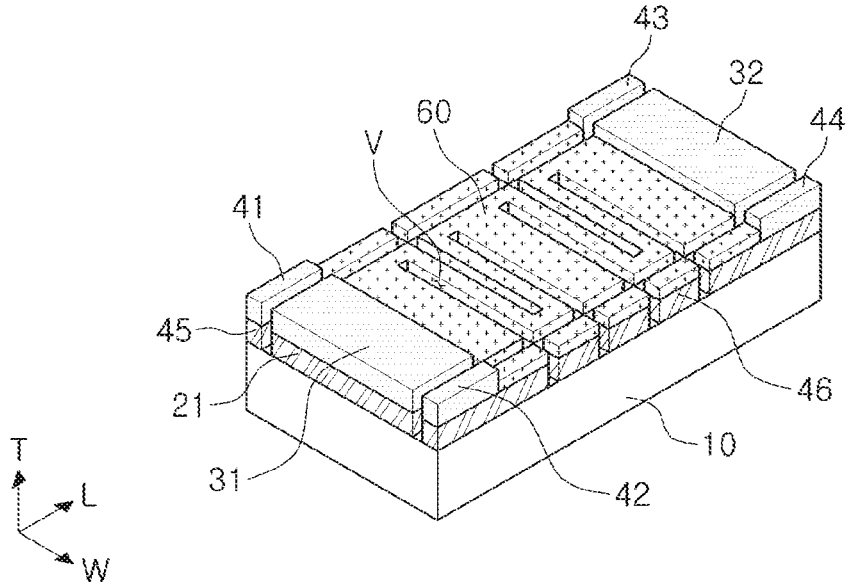

FIGS. 5A and 5B are views illustrating a manufacturing method of an electronic component according to an exemplary embodiment in the present disclosure.

According to the manufacturing method of an electronic component according to an exemplary embodiment in the present disclosure, after the primary resistance pattern and the primary electrode pattern are formed, that is, after the processes described with reference to FIGS. 1A through 1E are completed, an inorganic protective film (e.g., an insulating layer) 61 may be formed on a portion at which the resistive film 110 (FIG. 1E) is exposed. The inorganic protective film 61 may include oxide including silicon dioxide ($SiO_2$), aluminum oxide ($Al_2O_3$), nitride, or the like. The inorganic protective film 61 may have mechanical strength greater than that of the resistance pattern or the electrode. In addition, the inorganic protective film 61 may be an insulator.

After the inorganic protective film 61 is formed, a resistance pattern 21 may be formed by forming a groove in the resistive film (FIG. 5A). The process of forming the resistance pattern may be the same as the process described with reference to FIG. 1F.

Next, a resistance portion 20 of the chip resistor may be formed by forming at least one pattern groove V in the resistance pattern 21 on which the inorganic protective film 61 is formed (FIG. 5B). This process may be the same as that described with reference to FIG. 1G except that the at least one pattern groove V is formed in both the inorganic protective film 61 and the resistance pattern 21.

Figure 6A:
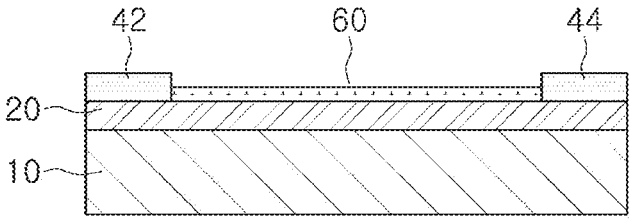
FIGS. 6A through 6C are views schematically illustrating an electronic component manufactured according to the manufacturing method of the electronic component according to an exemplary embodiment in the present disclosure illustrated in FIGS. 1A through 1E, 5A, and 5B.
Figure 6B:
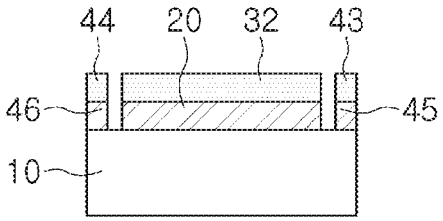
Figure 6C:
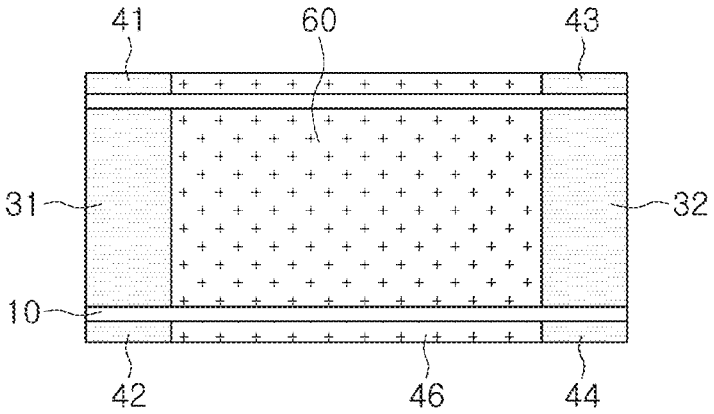

FIGS. 6A through 6C are views schematically illustrating an electronic component manufactured according to the manufacturing method of the electronic component according to an exemplary embodiment in the present disclosure illustrated in FIGS. 1A through 1E, and FIGS. 5A and 5B, FIG. 6A illustrates a front view when viewed in the width direction of the electronic component, FIG. 6B is a side view when viewed in the length direction thereof, and FIG. 6C illustrates a plan view when viewed in the thickness direction thereof.

As illustrated in FIGS. 6A through 6C, the electronic component according to an exemplary embodiment in the present disclosure may include the substrate 10, the resistance portion 20 disposed on the substrate 10 and extending in the first direction (e.g., the length direction of the substrate), the first dummy resistance pattern 45 and the second dummy resistance pattern 46 disposed to be spaced apart from the resistance portion 20 at opposite sides of the resistance portion 20 in the second direction and disposed on the substrate 10, the inorganic protective film 60 disposed in a space between the first electrode pattern 31 and the second electrode pattern 32 on the resistance portion 20, a space between the first dummy electrode pattern 41 and the third dummy electrode pattern 42 on the first dummy resistance pattern 45, and a space between the second dummy electrode pattern 42 and the fourth dummy electrode pattern 44 on the second dummy resistance pattern 46, the first electrode pattern 31 and the second electrode pattern 32 disposed at opposite ends of the resistance portion 20 in the first direction and disposed on the resistance portion 20, the first dummy electrode pattern 41 and the second dummy electrode pattern 42 disposed to be spaced apart from the first electrode pattern 31 at opposite sides of the first electrode pattern 31 in the second direction (e.g., the width direction of the substrate) different from the first direction and disposed on the substrate 10, and the third dummy electrode pattern 43 and the fourth dummy electrode pattern 44 disposed to be spaced apart from the second electrode pattern 32 at opposite sides of the second electrode pattern 32 in the second direction (e.g., the width direction of the substrate) different from the first direction and disposed on the substrate 10.

According to an exemplary embodiment in the present disclosure illustrated in FIGS. 5A through 6C, after the inorganic protective film is formed on the resistive film, a laser process may be applied thereto. Therefore, an occurrence of conductive scattering materials of the resistive film and/or conductive scattering materials of the electrode may be prevented when the resistive film (or the resistance pattern) is processed with the laser. In addition, a problem of electrical characteristic instability in the chip resistor, which is the final product, that is, reliability of the product that may be caused by the conductive scattering materials of the resistive film, the conductive scattering materials of the electrode, or thin film residues that may remain on the substrate may also be improved.

FIGS. 7A through 8B are views illustrating a manufacturing method of an electronic component according to an exemplary embodiment in the present disclosure. As illustrated in FIGS. 7A through 8B, the electronic component according to an exemplary embodiment in the present disclosure may include at least one open pattern S. A process of forming the open pattern S may be performed after forming the inorganic protective film 61 described with reference to FIG. 5A.

Figure 7A:
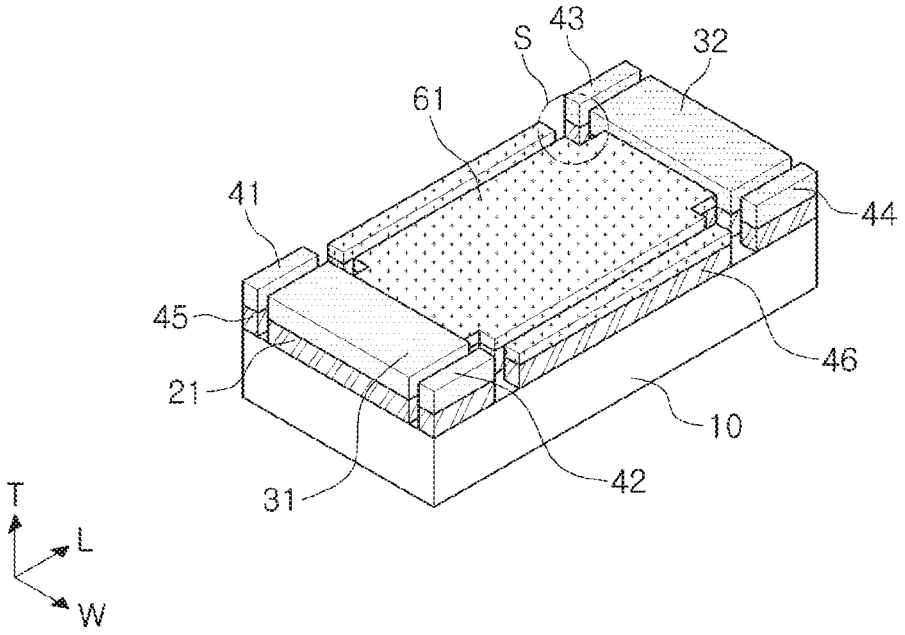
FIGS. 7A through 9C are views illustrating a manufacturing method of an electronic component according to an exemplary embodiment in the present disclosure.
Figure 7B:
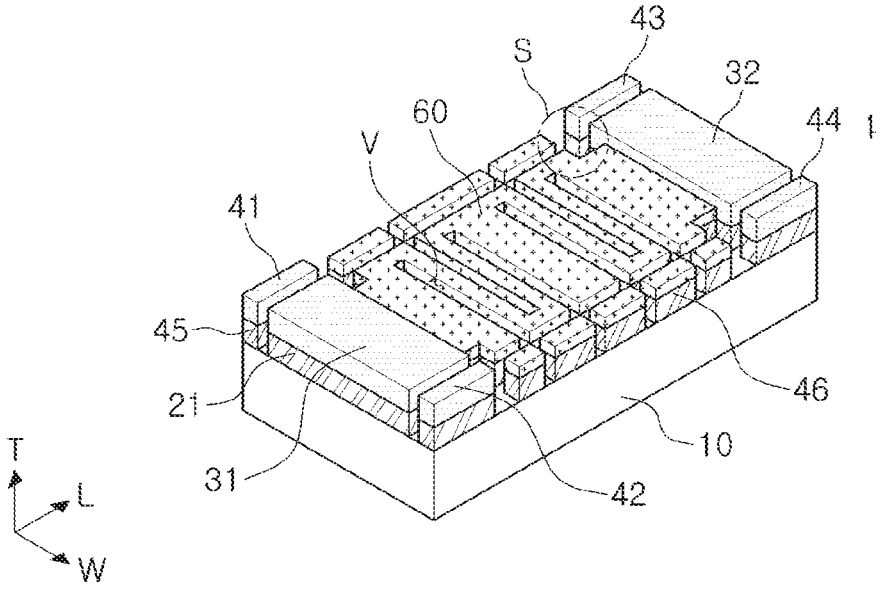

Specifically, as illustrated in FIGS. 7A and 7B, open patterns S may be formed at boundary portions at which the resistance pattern 21 is in contact with the first electrode pattern 31 and the second electrode pattern 32, and at least one pattern groove V may be then formed in the resistance pattern 21.

Figure 8A:
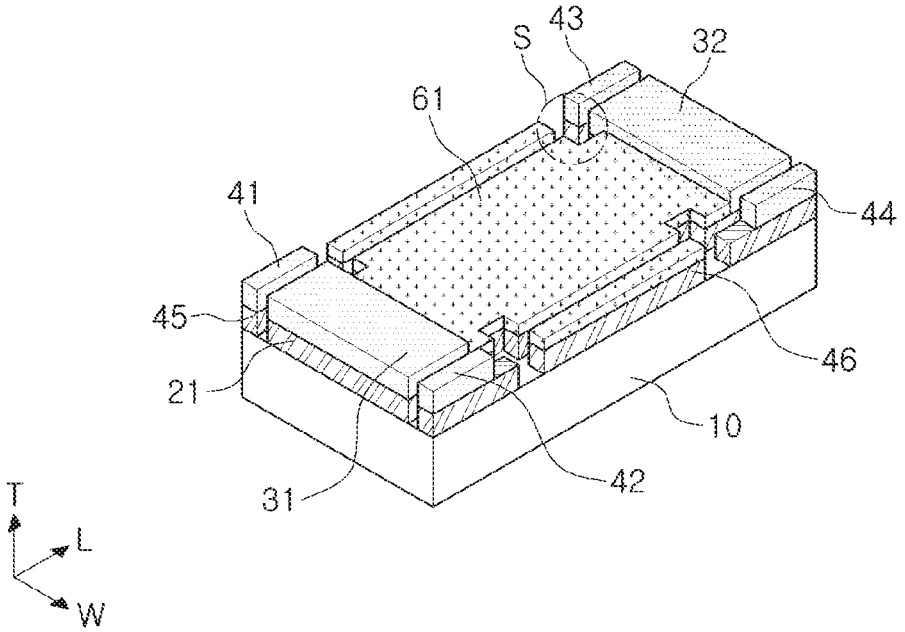
Figure 8B:
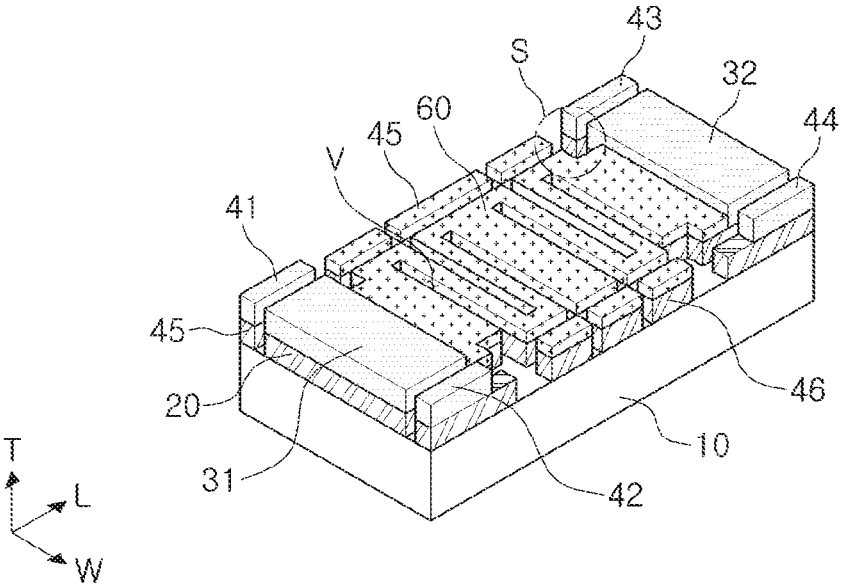

In addition, as illustrated in FIGS. 8A and 8B, at least one open pattern may be spaced apart from the boundary portions at which the resistance pattern 21 is in contact with the first electrode pattern 31 and the second electrode pattern 32, and at least one pattern groove V may be then formed in the resistance pattern 21.

Figure 9A:
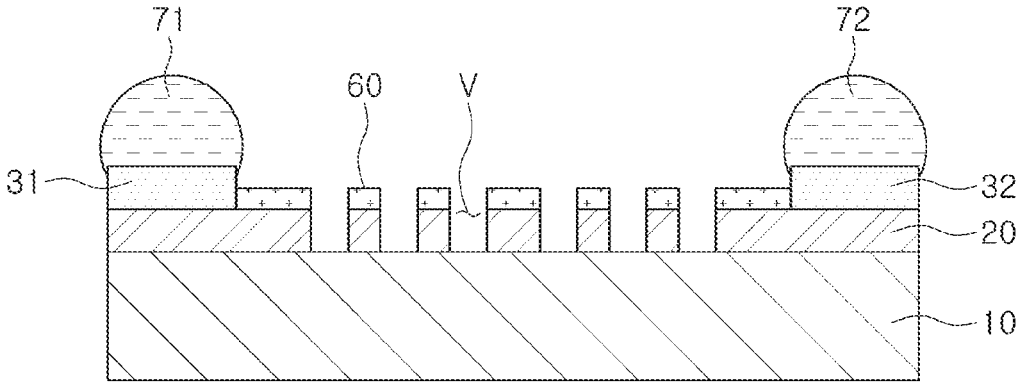
Figure 9B:
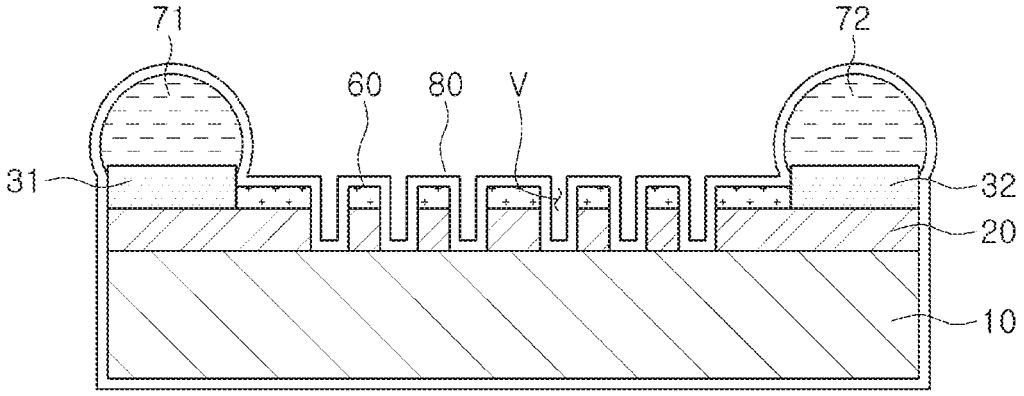
Figure 9C:
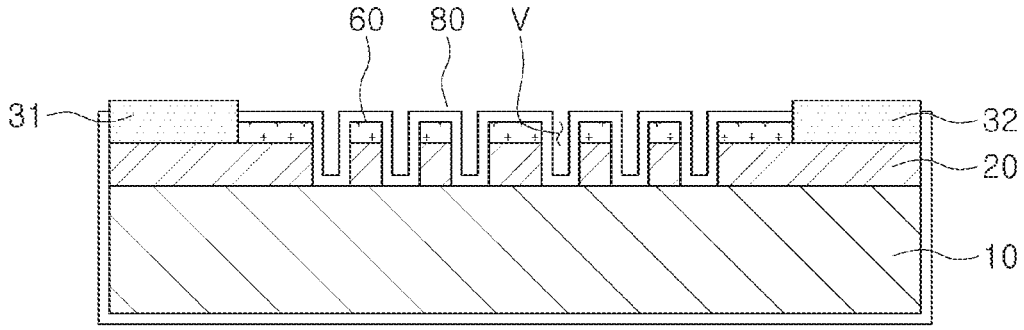

FIGS. 9A through 9C are views illustrating a manufacturing method of an electronic component according to an exemplary embodiment in the present disclosure. FIGS. 9A through 9C illustrate a cross-sectional views of a middle portion of the electronic component according to an exemplary embodiment in the present disclosure in the width direction thereof taken along the length direction thereof.

According to the manufacturing method of an electronic component according to an exemplary embodiment in the present disclosure, an additional secondary protective film may be formed on the remaining portions except for the electrode patterns.

Specifically, after forming the substrate 10, the resistance portion 20, the first electrode pattern 31, the second electrode pattern 32, and the inorganic protective film 60 are formed through the processes of FIGS. 1A through 1G, and FIGS. 5A and 5B, third paste portions 71 and 72 may be formed on the first electrode pattern 31 and the second electrode pattern 32, respectively (FIG. 9A). The third paste portions 71 and 72 may be formed by a screen print method. The third paste portions 71 and 72 may be a mixture of an organic material and an inorganic material.

Next, a secondary protective film 80 may be formed (FIG. 9B). The secondary protective film may be formed by a chemical vapor deposition (CVD) method. As illustrated in FIG. 9B, the secondary protective film 80 may be formed on exposed portions (i.e., portions in which the pattern groove is formed) of the resistance portion 20 and the substrate 10, as well as on the inorganic protective film 60.

Next, the third paste portions 71 and 72 may be removed (FIG. 9C). The third paste portions 71 and 72 may be removed by an organic material remover.

Figure 10A:
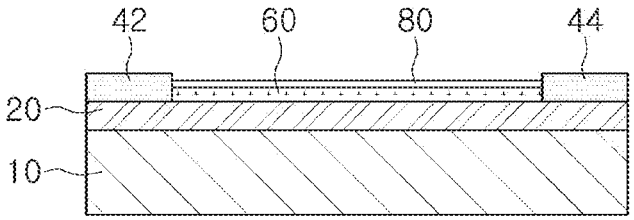
FIGS. 10A through 10C are views schematically illustrating an electronic component manufactured according to the manufacturing method of the electronic component according to an exemplary embodiment in the present disclosure illustrated in FIGS. 1A through 1G, 5A, 5B, and 9A through 9C.
Figure 10B:
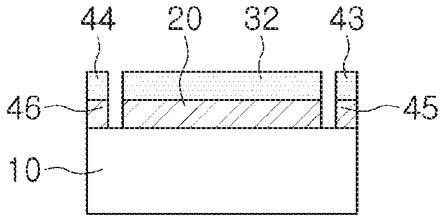
Figure 10C:
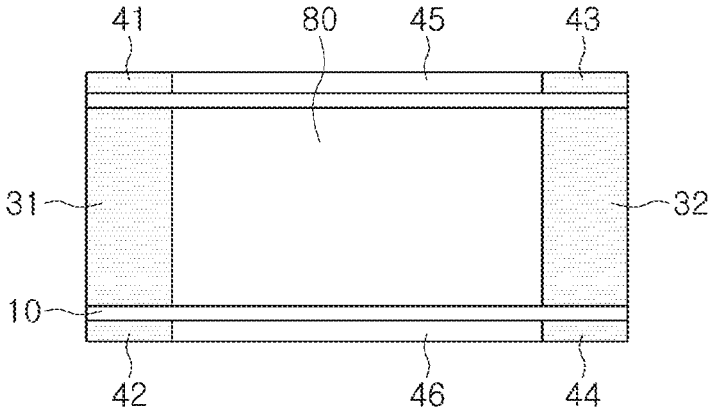

FIGS. 10A through 10C are views schematically illustrating an electronic component manufactured according to the manufacturing method of the electronic component according to an exemplary embodiment in the present disclosure illustrated in FIGS. 1A through 1G, FIGS. 5A and 5B, and FIGS. 9A through 9C, FIG. 10A illustrates a front view when viewed in the width direction of the electronic component, FIG. 10B is a side view when viewed in the length direction thereof, and FIG. 10C illustrates a plan view when viewed in the thickness direction thereof.

As illustrated in FIGS. 10A through 10C, the electronic component according to an exemplary embodiment in the present disclosure may include the substrate 10, the resistance portion 20 disposed on the substrate 10 and extending in the first direction (e.g., the length direction of the substrate), the first dummy resistance pattern 45 and the second dummy resistance pattern 46 disposed to be spaced apart from the resistance portion 20 at opposite sides of the resistance portion 20 in the second direction and disposed on the substrate 10, the inorganic protective film 60 disposed in a space between the first electrode pattern 31 and the second electrode pattern 32 on the resistance portion 20 and a space between the first electrode pattern 31 and the second electrode pattern 32 on the first dummy resistance pattern 45 and the second dummy resistance pattern 46, the secondary protective film 80 formed on the exposed portions (i.e., the portions in which the pattern groove is formed) of the inorganic protective film 60, the resistance portion 80, and the substrate 10, the first electrode pattern 31 and the second electrode pattern 32 disposed at opposite ends of the resistance portion 20 in the first direction and disposed on the resistance portion 20, the first dummy electrode pattern 41 and the second dummy electrode pattern 42 disposed to be spaced apart from the first electrode pattern 31 at opposite sides of the first electrode pattern 31 in the second direction (e.g., the width direction of the substrate) different from the first direction and disposed on the substrate 10, and the third dummy electrode pattern 43 and the fourth dummy electrode pattern 44 disposed to be spaced apart from the second electrode pattern 32 at opposite sides of the second electrode pattern 32 in the second direction (e.g., the width direction of the substrate) different from the first direction and disposed on the substrate 10.

Although FIGS. 9A through 10C illustrate that the electronic component according to an exemplary embodiment in the present disclosure includes all the two protective films (i.e., the inorganic protective film 60 and the secondary protective film 80), the electronic component according to an exemplary embodiment in the present disclosure may also include only the secondary protective film 80.

Although not illustrated in FIGS. 2A through 2C, FIGS. 6A through 6C, and FIGS. 10A through 10C, the electronic component according to an exemplary embodiment in the present disclosure may have at least one pattern groove formed therein.

In addition, although not illustrated in FIGS. 2A through 2C, FIGS. 6A through 6C, and FIGS. 10A through 10C, the electronic component according to an exemplary embodiment in the present disclosure may further include a protective film disposed on the resistance portion 20. In addition, the electronic component according to an exemplary embodiment in the present disclosure may further include a plating layer formed on at least one side of the first electrode pattern 31 and the second electrode pattern 32, for example, on the first electrode pattern 31 and the second electrode pattern 32.

In addition, although the thin film chip resistor is described as an example of the electronic component according to the present disclosure, the electronic component according to the present disclosure is not limited to the resistor. Therefore, the resistive film, the resistance pattern, and the resistance portion may be substituted with a conductor film, a conductor pattern, and a conductor pattern portion, respectively.

As set forth above, according to the exemplary embodiment in the present disclosure, the electronic component and the manufacturing method thereof may reduce the manufacturing costs of the electronic component while miniaturizing and thinning the electronic component.

While exemplary embodiments have been shown and described above, it will be apparent to those skilled in the art that modifications and variations could be made without departing from the scope of the present invention as defined by the appended claims.

What is claimed is:

1. An electronic component comprising:

a substrate;

a conductor pattern portion disposed on the substrate and extending in a first direction;

a first electrode pattern and a second electrode pattern disposed at opposite ends of the conductor pattern portion in the first direction, respectively, and disposed on the conductor pattern portion;

at least one dummy conductor pattern spaced apart from the conductor pattern portion and disposed on the substrate; and at least one dummy electrode pattern spaced apart from the first electrode pattern and the second electrode pattern and disposed on the at least one dummy conductor pattern, wherein a width, in a second direction different from the first direction, of the first electrode pattern is substantially the same as a width, in the second direction different from the first direction, of a portion of the conductor pattern portion in contact with the first electrode pattern, and a width, in the second direction different from the first direction, of the second electrode pattern is substantially the same as a width, in the second direction different from the first direction, of a portion of the conductor pattern portion in contact with the second electrode pattern.

2. The electronic component of claim 1, wherein the at least one dummy conductor pattern includes:

a first dummy conductor pattern disposed on one side of the conductor pattern in the second direction; and a second dummy conductor pattern disposed on the other side of the conductor pattern portion in the second direction.

3. The electronic component of claim 2, wherein the at least one dummy electrode pattern includes:

a first dummy electrode pattern disposed on one side of the first electrode pattern in the second direction and disposed on the first dummy conductor pattern;

a second dummy electrode pattern disposed on the other side of the first electrode pattern in the second direction and disposed on the second dummy conductor pattern;

a third dummy electrode pattern disposed on one side of the second electrode pattern in the second direction and disposed on the first dummy conductor pattern; and a fourth dummy electrode pattern disposed on the other side of the second electrode pattern in the second direction and disposed on the second dummy conductor pattern.

4. The electronic component of claim 1, further comprising a protective film disposed on the conductor pattern portion and having substantially the same width as a width of the conductor pattern portion.

5. The electronic component of claim 4, wherein the conductor pattern portion is a resistance portion including at least one pattern groove, and the protective film includes the same pattern groove as the at least one pattern groove disposed in the conductor pattern portion.

6. The electronic component of claim 1, further comprising at least one open pattern extending from one side surface of the conductor pattern to the at least one dummy conductor pattern and disconnecting the conductor pattern from the at least one dummy electrode pattern.

7. A manufacturing method of an electronic component, the manufacturing method comprising:

forming a conductor film extending from one edge to another edge of a substrate in a second direction of the substrate;

forming at least one paste portion extending from one edge to another edge of the conductor film in the second direction;

forming an electrode film extending, in the second direction, from the one edge to the another edge of the conductor film on the substrate on which the conductor film and the at least one paste portion are formed; and forming a plurality of primary electrode patterns by removing the at least one paste portion, wherein the plurality of primary electrode patterns are spaced apart from each other in a first direction of the substrate crossing the second direction.

8. The manufacturing method of claim 7, wherein the at least one paste portion is formed by a printing method, and the conductor film and the electrode film are formed by a film sputtering method.

9. The manufacturing method of claim 7, further comprising forming a conductor pattern portion extending in the first direction by forming a groove extending in the first direction, at least one dummy conductor pattern spaced apart from the conductor pattern portion, a first electrode pattern and a second electrode pattern disposed at opposite ends of the conductor pattern in the first direction, respectively, and at least one dummy electrode pattern spaced apart from the first electrode pattern and the second electrode pattern.

10. The manufacturing method of claim 9, further comprising forming an open pattern extending from one side surface of the conductor pattern portion to the at least one dummy conductor pattern and disconnecting the conductor pattern from the at least one dummy electrode pattern.

11. The manufacturing method of claim 7, further comprising:

forming a first protective film on portions of the conductor film on which the plurality of primary electrode patterns are not formed; and forming a conductor pattern portion extending in the second direction by forming a groove extending in the first after forming the first protective film, at least one dummy conductor pattern spaced apart from the conductor pattern portion, a first electrode pattern and a second electrode pattern disposed at opposite ends of the conductor pattern in the first direction, respectively, and at least one dummy electrode pattern spaced apart from the first electrode pattern and the second electrode pattern.

12. The manufacturing method of claim 11, further comprising forming at least one pattern groove in the conductor pattern portion.

13. The manufacturing method of claim 12, further comprising forming a secondary protective film on the primary protective film and a surface of the pattern groove.

14. A manufacturing method of an electronic component, the manufacturing method comprising:

forming a conductor film on a substrate;

forming at least one paste portion extending in a second direction on the substrate on which the conductor film is formed;

after forming the at least one paste portion, forming an electrode film to cover the conductor film and the at least one paste portion; and forming a plurality of primary electrode patterns, by removing the at least one paste portion and a portion of the electrode film covering the at least one paste portion.

15. The manufacturing method of claim 14, wherein the at least one paste portion is formed by a printing method, and the conductor film and the electrode film are formed by a film sputtering method.

16. The manufacturing method of claim 14, further comprising forming a conductor pattern portion extending in a first direction by forming a groove extending in the first direction different from the second direction, at least one dummy conductor pattern spaced apart from the conductor pattern portion, a first electrode pattern and a second electrode pattern disposed at opposite ends of the conductor pattern in the first direction, respectively, and at least one dummy electrode pattern spaced apart from the first electrode pattern and the second electrode pattern.

17. The manufacturing method of claim 16, further comprising forming an open pattern extending from one side surface of the conductor pattern portion to the at least one dummy conductor pattern and disconnecting the conductor pattern from the at least one dummy electrode pattern.

18. The manufacturing method of claim 14, further comprising:

forming a first protective film on portions of the conductor film on which the plurality of primary electrode patterns are not formed; and forming a conductor pattern portion extending in a first direction by forming a groove extending in the first direction different from the second direction after forming the first protective film, at least one dummy conductor pattern spaced apart from the conductor pattern portion, a first electrode pattern and a second electrode pattern disposed at opposite ends of the conductor pattern in the first direction, respectively, and at least one dummy electrode pattern spaced apart from the first electrode pattern and the second electrode pattern.

19. The manufacturing method of claim 18, further comprising forming at least one pattern groove in the conductor pattern portion.

20. The manufacturing method of claim 19, further comprising forming a secondary protective film on the primary protective film and a surface of the pattern groove.

* * * * *